US008061449B2

(12) United States Patent
Haglund

(10) Patent No.: US 8,061,449 B2
(45) **Date of Patent: *Nov. 22, 2011**

(54) HOUSING ARRANGEMENT

(75) Inventor: Jan Haglund, Karlskoga (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

This patent is subject to a terminal disclaimer.

(21) Appl. No.: 12/799,124

(22) Filed: Apr. 19, 2010

(65) Prior Publication Data

US 2010/0270083 A1 Oct. 28, 2010

Related U.S. Application Data

(63) Continuation of application No. 11/658,279, filed as application No. PCT/SE2005/001414 on Sep. 27, 2005, now Pat. No. 7,730,973.

(30) Foreign Application Priority Data

Oct. 7, 2004 (SE) ..... 0402423

(51) Int. Cl.
*E21B 19/08* (2006.01)

(52) U.S. Cl. ..... 175/162

(58) Field of Classification Search ..... 175/162, 175/DIG. 2; 181/198, 200; 166/75.11
See application file for complete search history.

(56) References Cited

U.S. PATENT DOCUMENTS 7,730,973 B2 * 6/2010 Haglund ..... 175/162
7,861,804 B2 * 1/2011 Haglund ..... 175/325.1

FOREIGN PATENT DOCUMENTS

DE 2455343 A * 5/1976
JP 04070416 A * 3/1992

* cited by examiner

*Primary Examiner* — Kenneth L Thompson
(74) *Attorney, Agent, or Firm* — Mark P. Stone

(57) ABSTRACT

Housing arrangement 8 for a drill rig, especially adapted for damping sound, said drill rig comprising a feed beam holder 3, a feed beam 4 being movably attached to the feed beam holder 3 and having a drill end 41 and a rear end 42, and a drilling machine 5 being movably attached to and movably along the feed beam 4, said housing arrangement 8 comprising a casing 7, and said feed beam 4. The invention is characterized in that the casing 7 is directly attachable to the feed beam 4, such that the casing 7 and at least a part of the feed beam 4 enclose the drilling machine 5, and allows for mutual movement between the feed beam 4 and the feed beam holder 3.

22 Claims, 1 Drawing Sheet

HOUSING ARRANGEMENT

Figure 1:
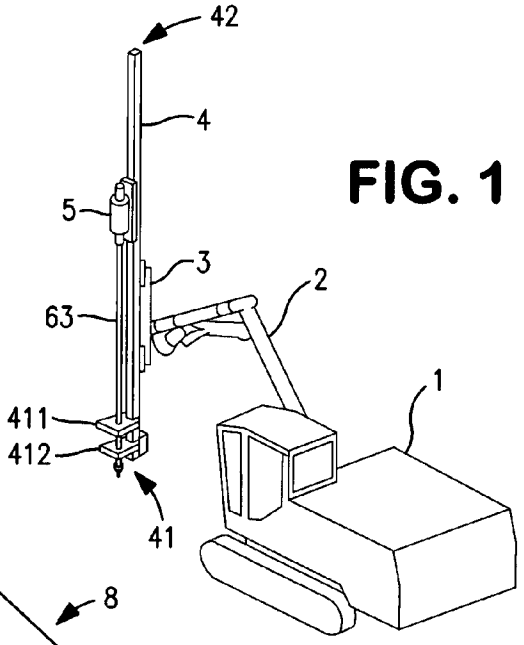

The present application is a continuation of Ser. No. 11/658,279, filed Jan. 23, 2007 (currently pending before the Patent and Trademark Office), which is the U.S. National Phase of PCT/SE2005/001414, filed Sep. 27, 2005, pursuant 35 U.S.C. Section 371, which claims priority from Swedish Patent Application No. 0403423-8, filed on Oct. 7, 2004, pursuant to 35 U.S.C. Section 119(a).

TECHNICAL FIELD

The present invention relates to a housing arrangement for a drill rig, especially adapted for damping sound, in accordance with the preamble of the independent claim. The present invention also relates to a drill rig comprising such housing arrangement.

BACKGROUND OF INVENTION

Drilling equipment of different kinds generate sound, and especially heavy drill equipment such as rock drill rigs used for surface or underground drilling.

Generally, a rock drill rig (FIG. 1) comprises a movable carrier, a boom and a feed beam connected to the boom via e.g. a feed beam holder. The feed beam and the feed beam holder are movable in relation to each other along at least part of the length of the feed beam, to enable relative movement between the feed beam and the boom. A drilling machine is movable along the feed beam, affecting the drill string to be forced into the ground. The drill string comprises the drill point (drill bit) and the joined rods.

Disturbing sound is for instance generated at the drilling machine and at the drill point. It is therefore desirable to dampen the generated sound to the surroundings. Various arrangements for screening off the sound generated at the drilling machine are known.

U.S. Pat. No. 3,667,571 discloses a multilayer housing enclosing the drilling equipment and the feed beam. The feed beam is suspended in the housing via dampening members, thereby making the positioning and the whole construction unstable and not applicable in modern drill rigs.

WO02/070856 discloses a housing of flexible sheets that encloses the drilling equipment and the feed beam. A longitudinal opening is arranged, which enables the operator to monitor the drilling process and to scarf rods to the drill string. The housing is fastened to the feed beam via bars. It is assumed that the elongated opening, to a certain degree, leaks sound to the surroundings. Furthermore, the smaller the opening is made to reduce the noise, the harder it gets for the operator to monitor and scarf (join) the rods.

JP5079271 shows another type of housing, enclosing a drill machine that is movable on a feed beam.

WO00/39412 discloses a housing arranged to the feed beam, enclosing the drilling equipment and the feed beam, and it may also enclose the feed beam holder. The housing is attached to the feed beam via brackets, and is arranged with an operiing for enabling the movement between the feed beam and the boom. The opening is arranged with a so called "noise curtain" of e.g. bristles to seal the opening. Despite the noise curtain; sound is spread to the environment through the opening. Furthermore, the hatches arranged in the housing are relatively small, which makes it difficult to monitor e.g. scarfing.

A major drawback of the prior art housings is that they fail in enabling sound dampening of the sound generating parts and at the same time allow for relative movement between the feed beam and the feed beam holder.

BRIEF DESCRIPTION

One object with the present invention is to achieve an arrangement that seals the sound generating parts, and at the same time allows for relative movement between feed beam and feed beam holder. This is solved by the features set forth in the characterizing portion of the independent claim.

One other object is to allow for easy access and a possibility to look into the arrangement at operation. This is solved by the features set forth in the dependent claims.

Preferred embodiments are set forth in the dependent claims.

According to a main aspect, the present invention relates to a housing arrangement for a drill rig, especially adapted for damping sound, said drill rig comprising a feed beam holder, a feed beam being movably attached to the feed beam holder and having a drill end and a rear end, and a drilling machine being movably attached to and movable along the feed beam, said housing arrangement comprising a casing, and said feed beam. The invention is characterized in that the casing is directly attachable to the feed beam, such that the casing and at least a part of the feed beam enclose the drilling machine, and allows for mutual movement between the feed beam and the feed beam holder. The housing arrangement makes use of the one side of the feed beam as a sealing surface, which enables enclosing of the sound generating apparatus, and simultaneously allows relative movement between feed beam and feed beam holder.

According to another aspect, the housing arrangement according to the invention comprises remotely controlled and/or transparent doors. The openable doors have the advantage that they give easy access to the interior of the housing for service and monitoring. If the doors are remotely controlled and/or transparent, the operator saves time by not always having to leave his seat.

These and other aspects of, and advantages with the present invention will be apparent from the detailed description and the accompanying drawings.

SHORT DESCRIPTION OF DRAWINGS

Figure 2:
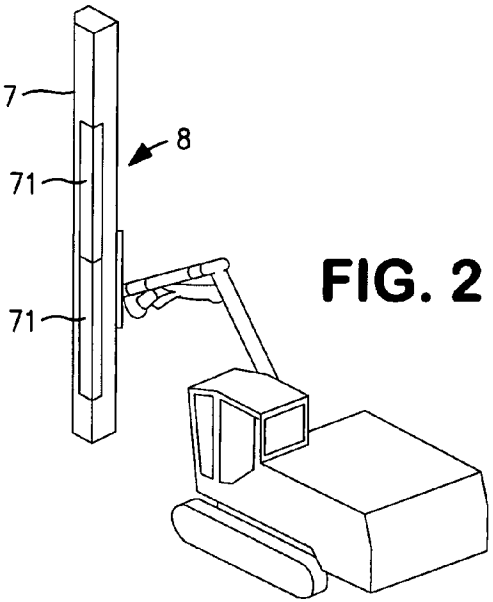
Figure 3:
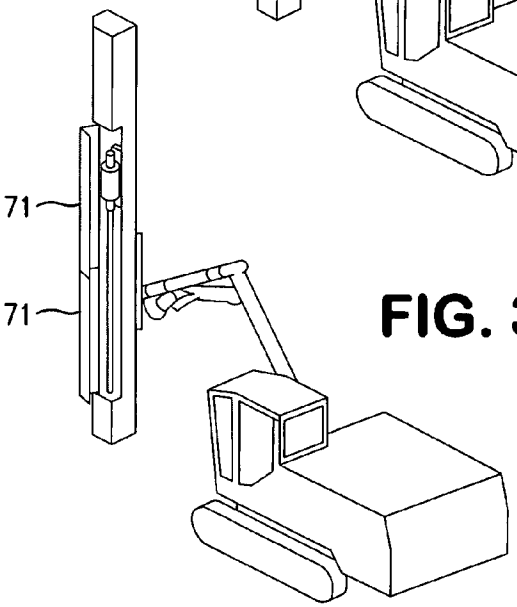
Figure 4:
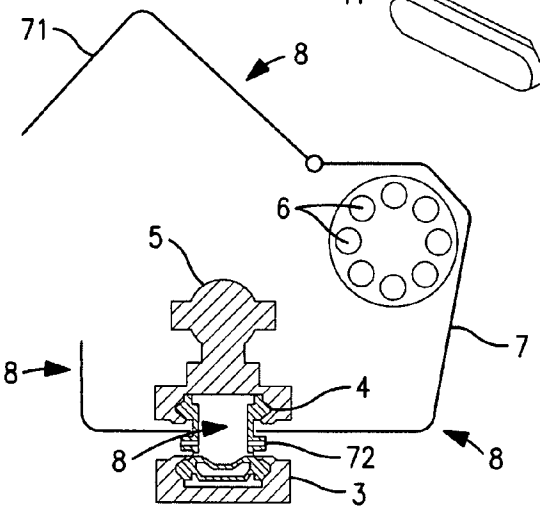

In the detailed description of the present invention reference will be made to the accompanying drawings, wherein FIG. 1 shows a schematic view of a rock drill rig, FIG. 2 shows a perspective view of a drill rig with a housing arrangement according to the invention, FIG. 3 shows a perspective view of a drill rig with a housing arrangement with open doors, FIG. 4 shows a schematic cross section of the invention.

DETAILED DESCRIPTION

FIG. 1 shows a schematic view of a rock drill rig comprising a movable carrier 1, a boom 2 and a feed beam 4 connected to the boom 2 via a feed beam holder 3. The feed beam 4 and the feed beam holder 3 are movable in relation to each other along at least part of the length of the feed beam 4. A drilling machine 5 is movably attached to the feed beam 4, and is movable along the feed beam 4 to affect the drill string 63. The drill string 63 comprises the drill point (drill bit) and the joined rods 6 (not shown in FIG. 1). Other equipment attached to the feed beam 4, may be equipment for e.g. rod handling, bolting, and loading of explosives.

The feed beam 4 has a drill end 41 from which the drill point protrudes at drilling, and a rear end 42 opposite the drill end 41. A first and/or a second part 411, 412 of the feed beam 4 are, arranged near the drill end 41. The first part 411 being fixed in relation to the feed beam 4, and the second part 412 being movable in relation to the feed beam 4 in a longitudinal direction. The first and/or second parts 411, 412 may be constituted by drill guides or similar arrangements on the feed beam 4.

With reference to FIGS. 2-4, the housing arrangement 8 according to the invention comprises a casing 7, and said feed beam 4. Thus, the feed beam 4 is a part of the housing arrangement 8.

The housing arrangement 8 shown in the drawings has a substantially angular cross section, but may be of any suitable form adapted to fit the equipment enclosed and also related to the material of the casing 7.

Preferably, the housing arrangement 8 has sealed inlet connections (not shown) for hoses/cables for e.g. electricity, air, oil, water and dust collection.

The casing 7 is directly attachable to the feed beam 4, such that the casing 7 and at least a part of the feed beam 4 encloses the drilling machine 5 and possibly other equipment attached to the feed beam 4, and allows for mutual movement between the feed beam 4 and the feed beam holder 3.

If the machine is equipped with automatic rod handling, this will not be obstructed by the housing arrangement 8, since the housing arrangement 8 also may enclose the automatic rod handling equipment and the rod supply (FIG. 4).

The casing 7 is attachable to the feed beam 4 by any suitable fastening means 72, e.g. bolts. In this way, the casing 7 moves together with the feed beam 4 in relation to the feed beam holder 3. The fastening means 72 enables that the casing 7 may be dismounted from the feed beam 4 to enable exchange and service.

The casing 7 covers the drilling machine from past the rear end 42 of the feed beam 4 to a part of the feed beam near the drill end 41—preferably to said first part 411 being fixed in relation to the feed beam 4. The casing 7 is provided with sidewalls being parallel in relation to the feed beam 4, and an end wall at the rear end 42 of the feed beam 4 closing that end of the casing 7. Thus, the casing 7 and the feed beam 4 together form a sound dampening housing arrangement 8 around the drill machine.

The walls of the casing 7 may consist of one or several panels, e.g. of metal, plastics or any other suitable material, coated at least on one-side with sound absorbing material. The sound absorbing material may be a foam, or a combination of structure-borne sound dampening mat and foam or any other suitable sound dampening material. The panel material and the sound absorbing material may be transparent.

Preferably, at least one door 71 is arranged in the casing 7 (FIGS. 2 and 3), to give access for scarfing of rods 6, service and/or observation. Said at least one door 71 may be remotely controlled by the operator, to facilitate monitoring from the operator's seat/cabin.

If the housing arrangement 8 is angular, the door 71 may be constituted by two sides for easy access into the housing arrangement 8. The door 71 may be arranged along a smaller or larger part of the length of the casing 7 (FIG. 3).

A part of the casing 7 (a side wall or door) may be transparent, enabling that the operation can be monitored without opening the door 71. The transparent part may be arranged with any suitable cleaning device to maintain good visibility.

When preparing a drilling operation, the drill rig carrier 1 is moved to the site where the drilling shall be performed. The feed beam 4, with the drilling machine 5, is put into position over the working point by assistance of the boom 2 and the feed beam holder 3.

Since the casing 7 is attached to the feed beam 4, the dampening housing arrangement 8 will follow the movement of the feed beam 4 being movable in relation to the feed beam holder 3, completely enclosing the equipment.

Thus, the housing arrangement according to the invention encloses the rock drilling machine 5, rod handling equipment 6 and other equipment attached to the feed beam 4, at the same time as it allows for relative movement between feed beam 4 and feed beam holder 3. It also enables protection of the feed beam 4 (the side facing the drilling machine) from dust and dirt.

A first drill rod 6 is forced into the rock by the drilling machine 5, while generating sound. As the first drill rod 6 penetrates the rock several rods 6 are subsequently scarfed to the drill string 63. The operator may open one or several doors 71 to perform e.g. scarfing, monitor automatic scarfing or monitor the drilling operation. If part of the casing 7 is transparent, the operator may monitor the operation therethrough.

The housing arrangement according to the invention may also be used in connection with other kinds of equipment similar to drilling such as geo-technical drilling equipment etc.

The housing arrangement according to the invention may be mounted to a drill rig at manufacture, but it is off course also possible to provide an existing rock drill rig with the housing arrangement according to the present invention. The casing may be dismounted to enable exchange and service.

The housing arrangement allows for positioning a receiver for a laser reference plane on the outside of the housing arrangement, with maintained possibility to measure the distance between the laser reference plane and the depth of the drill hole.

The embodiments shown in the drawings and put forward in the description should not be considered restricting, only as exemplifying.

The invention claimed is:

1. Casing for a drill rig, especially adapted for damping sound, wherein the casing is attachable to a feed beam of said drill rig, such that the casing and at least a part of the feed beam in combination define a sound dampening housing arrangement enclosing a drilling machine of said drill rig, and allowing for relative movement between the feed beam and a feed beam holder of said drill rig, wherein the walls of the casing comprise one or several panels coated on at least one side with sound absorbing material, and wherein said housing arrangement is arranged to seal the sound generating parts of said drill rig.

2. Casing according to claim 1, wherein the casing is provided with sidewalls being parallel in relation to the feed beam, and an end wall at a rear end of the feed beam closing that end of the casing.

3. Casing according to claim 1, wherein the casing is directly attachable to the feed beam by fastening means.

4. Casing according to claim 3, wherein the fastening means enables dismantling of the casing from the feed beam.

5. Casing according to claim 1, wherein the casing covers the drilling machine from past a rear end of the feed beam to a part of the feed beam near a drill end of the feed beam.

6. Casing according to claim 1, wherein the casing comprises sealed inlet connections for hoses and/or cables.

7. Casing according to claim 1, wherein the casing is transportable when mounted on the drill rig.

8. Casing according to claim 1, wherein the housing arrangement further encloses automatic handling equipment and rod supply for the drill rig.

9. Casing according to claim 1, wherein the casing is arranged with at least one door, and wherein said at least one door may be remotely controlled.

10. Casing according to claim 1, wherein a part of the casing is transparent.

11. Casing according to claim 1, wherein a receiver for a laser reference plane is arranged on the outside of the housing arrangement.

12. Drill rig comprising a casing for a drill rig, especially adapted for damping sound, wherein said casing is attachable to a feed beam of said drill rig, such that the casing and at least a part of the feed beam in combination define a sound dampening housing arrangement enclosing a drilling machine of said drill rig, and allowing for relative movement between the feed beam and a feed beam holder of said drill rig, wherein the walls of the casing comprise one or several panels coated on at least one side with sound absorbing material, and wherein said housing arrangement is arranged to seal the sound generating parts of said drill rig.

13. Drill rig according to claim 12, wherein the casing is provided with sidewalls being parallel in relation to the feed beam, and an end wall at a rear end of the feed beam closing that end of the casing.

14. Drill rig according to claim 12, wherein the casing is directly attachable to the feed beam by fastening means.

15. Drill rig according to claim 14, wherein the fastening means enables dismantling of the casing from the feed beam.

16. Drill rig according to claim 12, wherein the casing covers the drilling machine from past a rear end of the feed beam to a part of the feed beam near a drill end of the feed beam.

17. Drill rig according to claim 12, wherein the casing comprises sealed inlet connections for hoses and/or cables.

18. Drill rig according to claim 12, wherein the casing is transportable when mounted on the drill rig.

19. Drill rig according to claim 12, wherein the housing arrangement further encloses automatic handing equipment and rod supply for the drill rig.

20. Drill rig according to claim 12, wherein the casing is arranged with at least one door, and wherein said at least one door may be remotely controlled.

21. Drill rig according to claim 12, wherein a part of the casing is transparent.

22. Drill rig according to claim 12, wherein a receiver for a laser reference plane is arranged on the outside of the housing arrangement.

* * * * *